United States Patent [19]

Mansson et al.

[11] Patent Number: 4,565,662

[45] Date of Patent: Jan. 21, 1986

[54] METHOD FOR THE PRODUCTION OF PARTICLE BOARDS

[75] Inventors: Björn Mansson; Kurt Sirenius, both of Sundsvall; Birger Sundin, Nacka, all of Sweden

[73] Assignee: AB Casco, Stockholm, Sweden

[21] Appl. No.: 489,721

[22] Filed: Apr. 29, 1983

[30] Foreign Application Priority Data

May 6, 1982 [SE] Sweden ..... 8202856

[51] Int. Cl.[4] ..... D04H 1/64

[52] U.S. Cl. ..... 264/113; 264/109

[58] Field of Search ..... 264/109, 113, 128

[56] References Cited

U.S. PATENT DOCUMENTS 3,297,603 1/1967 Mase ..... 264/128

FOREIGN PATENT DOCUMENTS 2553459 6/1977 Fed. Rep. of Germany .

2740207 9/1977 Fed. Rep. of Germany .

2019854 11/1979 United Kingdom .

OTHER PUBLICATIONS

Particleboard, A. A. Moslemi, Southern Illinois University Press, 1974, pp. 109–117 and 91–95.

Particleboard Manufacture, Leo Mitlin, Pressmedia Ltd., 1968, pp. 22–25, 34, 35, 62 and 63.

*Primary Examiner*—Jan Silbaugh

*Assistant Examiner*—V. Fischbach

*Attorney, Agent, or Firm*—Fred Philpitt

[57] ABSTRACT

A method for the production of particle boards by addition of a hydrophobing agent and a curable glue to wood based particles, shaping of the particle mass and subsequent curing of the glue by application of pressure and heat. The quality of the board is increased by keeping the hydrophobing agent heated above its melting temperature in the presence of the particles before the gluing.

10 Claims, No Drawings

METHOD FOR THE PRODUCTION OF PARTICLE BOARDS

TECHNICAL FIELD

The present invention relates to a method for producing particleboards which method comprises adding glue and a hydrophobing agent to wood particles and subsequently shaping the particles and curing the glue by application of pressure and heat.

BACKGROUND OF THE INVENTION

At the production of particleboards the amount of glue used for binding the particles is kept fairly low for economic reasons and around 10 percent based on the dry weight of the particles. This small amount of glue means that the quality of the produced boards and particularly their strength will be sensitive to variations in the production process and dependent also on minor changes of the operation conditions and in the raw-material composition. Particular problems concerning the strength arise when the production process includes steps for reducing the formaldehyde emission from the boards. It is well known that the curable formaldehyde based glue systems, and especially the urea-formaldehyde resins, which are used for the production of particleboards cause release of formaldehyde to some extent both at the production and the use of the boards. Several solutions for avoiding the hygienic problems associated with this emission of free formaldehyde have been suggested and those which are most generally applicable comprise addition of a formaldehyde absorbing agent to the particle material at the production of the boards. A process of this kind is known from DE-A-No. 1 055 806. However, since both the formaldehyde absorbing substance and the resin components of the resin glue are reactive against the formaldehyde problems will occur in these processes and there will be a decrease in strength due to the influence on the glue and an inactivation of the formaldehyde absorbent. Different methods of keeping the absorbing agent separated from the glue have consequently been suggested. The DE-A-No. 1 653 167 and DE-A-No. 2 553 459 suggest that only a part of the amount of particles, or other material is treated with the formaldehyde absorbing agent and then mixed with the main part of the particles to get a separation between the absorbent and the glue. However, the separation is poor in these methods, and, further, the uneven distribution of the absorbent leads to an unsatisfactory absorption. The additional phases also give rise to several economic and practical problems. A simplified method for adding the absorbent is suggested in the DE-A-2 740 207 and here a combined liquid for wax and absorbent is used but the separation of the absorbent and the glue is not improved by this method. According to the SE-C-No. 409 090 separation of the formaldehyde absorbing agent from the glue can be achieved by adding the absorbing agent in the form of a solution to particles having sufficiently low moisture content so that the solution will penetrate into the particles and so that there will not be any essential admixing with the glue which is added subsequently. However, for practical reasons it is not always possible to treat the dry particles and if a drying after the addition is desirable this will carry the absorbent back towards the surface of the particles.

THE INVENTION GENERALLY

It is an object of the present invention to avoid the above-mentioned problems at production of particleboards. One of the main objects of the invention is to increase the strength of the boards without increasing the amount of added glue. It is a special object of the invention to avoid the impairment of the strength which occurs when formaldehyde absorbing substances are added to the boards.

These objects are achieved by means of the characteristic features evident from the claims.

The invention relates to such methods for production of particles in which, in addition to the glue, a hydrophobing agent is added to the particles. The small amount of glue generally employed at the production of particleboards does not give a coating of glue on the surfaces of the particles in the finished board and this, in combination with the finely divided nature of the particles, result in a moisture sensitive product, which readily absorbs water and swells. For these reasons it is customary to add a hydrophobing agent in the form of a paraffin wax to the particle mixture at the production to decrease the moisture sensitivity. The hydrophobing agent is usually added with the glue, or just before or after the glue addition, so that these components will be at least partly mixed with each other before the pressing. Since the customary hydrophobing agents are solid at normal temperatures the agent will normally not melt and be completely mixed and distributed in the particle mixture until the pressing when the temperature is raised. According the present invention the hydrophobing agent shall instead be added to the particle mixture before the glue is added and in such a manner that it is heated above its melting temperature before the glue addition. At the heating the hydrophobing agent will spread and become distributed over the surfaces of the particles and is thus distributed when the glue is added. Several advantages are gained hereby. As the hydrophobing agent is well anchored to the particle surface, which is more hydrophobic than the glue, the risk that the hydrophobing agent and the glue will have a negative influence on each other is lessened. The layer of hydrophobing agent on the particle surfaces also acts as a barrier. It thereby prevents a too deep penetration of the glue into the particles and it concentrates the adhesion of the glue to the particle surfaces which gives an improved strength through an improved glue utilization. It has also been noted that it is sometimes possible to use shorter press times and that the finished board has a reduced swelling tendency. A still better barrier effect from the hydrophobing agent is achieved if drying takes place in connection with the heating and this is probably due to the fact that the evaporated moisture contributes to a concentration of the hydrophobing agent to the particle surfaces.

If a formaldehyde absorbing agent is added to the particles in such a manner that it is distributed on the particles before the hydrophobing agent is spread on the particle surfaces by the heating additional advantages are gained. The layer of hydrophobing agent will then act as a barrier also between the absorbent and the later added glue so that the desired separation of these components is considerably improved. The hydrophobic barrier between these hydrophilic components makes the separation particularly efficient. The separation can be utilized either as a higher strength at unchanged formaldehyde emission or as a lowered formaldehyde emission at unchanged strength. The barrier means that wetter particles can be used at the addition of the absorbing agent and that drying can be carried out without inconveniencies after the addition of the absorbent, which eliminates some of the practical disadvantages of previously known methods.

Further objects and advantages of the invention will be evident from the detailed description below.

DETAILED DESCRIPTION OF THE INVENTION

The invention relates to processes for the production of products, particularly boards, based on glued cellulose components or cellulose containing components, by which is to be understood products of wood and other not delignified cellulose containing materials which have been mechanically broken down, e.g. wood chips, saw dust, cutter shavings, cut-up products of flax, bagasse, sugar-canes and other coarser or finer wood fibre material etc. The size of the used particles may vary as long as the layered structure for the hydrophobing agent can be obtained, as said above, and as long as the glue is the essential binding element in the structure which normally is the case for particles down to individual cellulose fibres, for which other binding mechanisms come into action. The cellulose material is preferably chips.

The chip raw material has a high and varying moisture content originally, and the moisture content, i.e. the ratio of the weight of water to the dry weight of the chips, is generally between 30 and 120 percent. This moisture quantity must be reduced considerably before the final press operation can be carried out as high moisture contents lead to delamination of the boards in the press due to vapour. After all additions the moisture content should thus not exceed about 14 percent at the pressing operation. On the other hand, the drying can in principle be carried out at any time before the press operation. After addition of the hydrophobing agent according to the invention it is possible to dry extensively and the addition can thus be made to the above mentioned completely undried chips. However, it is preferred that some pre-drying is carried out, among other things in order to obtain a controlled and even moisture content and to obtain a more hydrophobic surface on the particles at the addition of the hydrophobing agent. It is possible to pre-dry the raw chips so far that no further drying is required before the pressing and that the chip mixture has a moisture content which is suitable for the pressing directly after the addition of the hydrophobing agent, optional formaldehyde absorbent, and the glue. The raw chips should then be dried to a moisture content below 6 percent, and preferably between 1 and 3 percent. However, it is preferred to leave at least so much moisture after the drying that a further drying step can be carried out later on. An initial drying of the chips can thus advantageously be carried out to a moisture content between 10 and 50 percent and preferably to between 15 and 30 percent. A drying of this kind can be carried out using known methods such as direct or indirect heating of the chips with hot air or hot flue gases.

Following the optional adjustment of the moisture content of the particles, according to what is said above, the hydrophobing agent is added. This agent can be of the conventional kind, i.e. a mineral wax or a natural or synthetic paraffin wax. However, any hydrophobing substance which can be distributed on the particles at an elevated temperature can be used. The hydrophobing agent shall be solid or at least not highly at room temperature but simultaneously it shall be capable of melting or becoming liquid at an increased temperature, suitably within the range of from 40° to 90° C. and preferably within the range of 50° to 60° C. Even if the hydrophobing agent does not have a distinct melting point it should thus be sufficiently fluid in these temperature ranges to allow individual particles thereof to fuse or to spread on or, preferably, to be absorbed by the particles. The amount of added hydrophobing agent is suitably from 0.1 to 5 percent of the dry weight of the particles and preferably between 0.2 to 1 percent.

The manner of adding the hydrophobing agent is of great importance for the possibility of obtaining the desired distribution. According to the invention the agent shall be kept heated above its softening temperature at least at some point of time in the presence of the particles so that it can flow out and be distributed on the surfaces of the particles. This means that the temperature should be kept above the previously stated temperature ranges for the melting point of the agent, i.e. above at least 40° C., preferably above 60° C. and most preferably above 70° C. The time during which the hydrophobing agent is kept heated in contact with the particle surfaces should be sufficient for distribution and should not be shorther than 1 second and should preferably exceed 5 seconds. It is preferred that the particles, and not only the hydrophobing agent, are kept heated since there will otherwise be a too rapid cooling of the agent before this has been efficiently distributed. The particles can be heated before the agent is added but are preferably heated after the addition. It is preferred that the hydrophobing agent is added to fairly cold particles, having a temperature below the melting point of the agent, and that the heating is carried out subsequently since this generally gives a better control and distribution of the agent. Further, it is suitable to keep the particles moving, and preferably to agitate them, during the heating stage and preferably also during the actual addition to further improve the distribution.

The hydrophobing agent can in a known manner be added in the form of a melt which is sprayed directly on to the particles. It is, however, preferred that known aqueous dispersions of the hydrophobing agent are used. Such dispersions usually contains between 25 and 65 percent by weight of a hydrophobing agent in a dispersion stabilized by emulsifiers or protective colloids. If such dispersions are added to the particles at a temperature below the melting point of the agent, as described above, the water content of the dispersion will become absorbed by the particle so that the hydrophobing agent is concentrated to the surfaces of the particles before the heating takes place, which improves adhesion and layer formation. The water content of the particles aids in limiting the penetration of the hydrophobing agent at the heating and concentrates it to the surfaces. The amount of added hydrophobing agent is small in relation to the amount of the particles and use of dispersions gives an increase of the handled composition amounts whereby the application is facilitated.

Preferably a drying operation is carried out in connection with the heating of the hydrophobing agent. The evaporated moisture helps to give a better distribution and concentration of the agent to the surfaces of the particles. It is suitable to remove at least 1 percent by weight, preferably at least 5 percent and most preferably at least 10 percent of the water in connection with the heating in this manner. This drying can be carried out using known methods, such as with hot air or hot flue gases in the same manner as is used for the pre-drying of the particles. In manufacturing units equipped with primary and secondary driers the addition of the hydrophobing agent can suitably be made between these driers.

As has been mentioned the method of the invention is especially useful in connection with addition of formaldehyde absorbing agents to the particles since the hydrophobing agent can then be made to contribute to a separation of these additives from the glue. As examples of formaldehyde absorbing agents can be mentioned nitrogen containing compounds such as melamine, diazine-, triazine- and amine compounds. The absorbing agent can be added in solid form or in the form of a slurry. The formaldehyde absorbing agent will be particularly satisfactory separated from the glue if it can penetrate somewhat into the particles and it is thus in some cases most suitable to use a solution of the absorbent in a solvent of proper volatility, e.g. alcohols. Water soluble compounds are preferably used and urea is particularly suitable. In order that the hydrophobing agent will form an efficient barrier between the absorbent and the glue the absorbent should be added to the particles at the latest at the same time as, and preferably before, the heating of the hydrophobic agent. It is suitable to have a penetration period also for the absorbent solution before the heating. The deepest penetration of an aqueous solution is obtained if the addition is made to dry particles, i.e. at a moisture content below about 6 percent and preferably between 1 and 3 percent. To make a later drying possible, as mentioned previously, in these cases water can be added after the absorbent has been added. The absorbent can, however, also be added to fairly wet particles which are later dried. This will certainly give a less deep penetration, which however can be accepted in the present method since the hydrophobing agent gives a satisfactory separation despite this.

For soluble formaldehyde absorbing agents it can be suitable, particularly when dry particles are treated, to use fairly concentrated solutions. For urea the concentration can vary between 20 and 60 percent by weight and it is especially advantageous to use between 30 and 50 percent by weight. In a known manner heating can be employed to raise the concentration of the solution. Since both the hydrophobing agent and the formaldehyde absorbing agent advantageously are added to the particles before the heating the additions can be made at the same time, and—for practical reasons, or to minimize the amount of added water, e.g. at treatment of dry particles—combined liquids can then advantageously be used, e.g. the known type of liquid which contains a hydrophobing agent dispersed in water and urea dissolved in the water. The urea content and the content of the hydrophobing agent are both then suitably between 5 and 50 percent, especially between 20 and 50 percent urea and between 10 and 30 percent of hydrophobing agent. The total dry content is between about 45 and 65 percent by weight, particularly between 50 and 60 percent. The amount of added formaldehyde absorbing substance can be between 0.1 and 5 percent by weight, based on the dry weight of the particles, preferably between 0.2 and 2 percent by weight and most preferably between 0.5 and 1.5 percent by weight.

Any other additive which it is desired to add to the particles in such a manner that it is kept separated from the glue can of course be added in a manner corresponding to the one described above for the formaldehyde absorbing agent.

After the heating, and the drying optionally carried out at the same time, the particles can, if required, in a known way be sieved or treated in any other manner. They can also without inconveniencies be stored intermediately during a long period of time as the additives are stably fixed to the particles.

To utilize the reduced glue penetration of particles treated according to the invention to the highest extent the gluing should be carried out just before the formation of the chip mat and the pressing. Gluing can be carried out in a conventional gluing machine.

The invention is applicable to all glue systems where it is desired to reduce glue penetration into the particles by means of a hydrophobic layer but is particularly useful for hydrophilic glue systems and especially for glues which are soluble or can be slurried in water. For reasons discussed above, the invention is particularly suitable for curable glue systems of formaldehyde based resins, such as condensation products of formaldehyde and urea, melamine, phenol, resorcinol, or co-condensates thereof. The invention solves the problems which arise at the use of urea-formaldehyde resins, or melamine-modified such resins, particularly well. For these resins low mole ratios are suitably used, e.g. mole ratios between formaldehyde and urea in the range of 1.0 to 1.8, preferably between 1.1 and 1.4 and most preferably between 1.2 and 1.35. The ratio of formaldehyde to melamine should be kept between 1.6 and 3.0 and particularly between 1.6 and 2.2.

The amount of added glue is usually between 7 and 14 percent dry resin on dry particles. These amounts can be used and give good bond strength. According to the method of the invention the glue penetration is reduced and this means that the amount of glue can also be reduced somewhat with maintained board quality, the glue addition can for example be reduced with from 0.5 to 2 percent units (dry/dry). Customary dry contents for the added glue mixture can be used and these are between 50 and 70 percent by weight. The moisture content of the particles after the gluing can be between 4 and 10 percent and particularly between 5 and 10 percent.

The mat formation can be carried out as usual and suitably with a more porous middle layer containing coarser particles. All the particle material for the board is preferably treated in a uniform manner but it is also possible, particularly for multi-layered panels, to have particles which have been differently treated in different layers of the board. However, the particles in each layer should be treated uniformly. For example, if desired formaldehyde absorbing agent can be added only to the middle-layer since the amount of free formaldehyde is greatest here.

Normal press times can be used, e.g. between 7 and 12 seconds per millimeter or board thickness in one-stage presses at a press temperature of about 185°–220° C. and will then give high binding strength. The press times at the method of the invention can often be reduced somewhat compared with conventional production methods since the bond strength is comparatively greater, the curing is more rapid and the tendency to delamination due to vapour blow is reduced.

EXAMPLE 1

Particleboards were prepared on a laboratory scale from particles of varying moisture contents according to the following:

A treating liquid containing 17.6 percent by weight of dispersed paraffin wax, having a melting point of about 52° C., 39.0 percent by weight of dissolved urea and 43.4 percent by weight of water was prepared.

In a first test (1) a reference was prepared from particles having a moisture content of 3%, which directly were mixed with 0.5% wax and glue, formed into a mat and pressed.

In a second series of tests (2 to 5) particles having moisture contents of 3, 6, 10 and 14%, respectively, were treated with 2.7 kg of the treating liquid per 100 kg of particles, dry weight, and the particles for tests 3 to 5 were dried with hot air of 120° C. to a moisture content of 3% and a final temperature of about 65° C.

In all the tests the particles were glued after the treatment with a urea-formaldehyde resin in an amount of 9 percent by weight (calculated as dry resin on dry particles), formed into a mat and pressed.

The results are shown in Table 1. As evident from the table (compare specially tests 1 and 2) the strength is reduced when wax and urea are added without heating and drying, while the strength is markedly increased at urea/wax-addition with simultaneous heating and drying.

TABLE 1

| Test | Density kg/m$^3$ | Internal bond MPa | Swelling 2 hours % | Dry content of sample at perforator test g/kg | Perforator value mg $CH_2O$/100 g |
|---|---|---|---|---|---|
| 1 | 690 | 0.88 | 9.6 | 932 | 20 |
| 2 | 700 | 0.77 | 11.1 | 935 | 7.6 |
| 3 | 671 | 1.04 | 8.2 | 932 | 8.5 |
| 4 | 657 | 0.98 | 9.7 | 940 | 8.4 |
| 5 | 670 | 1.01 | 8.7 | 936 | 7.2 |

EXAMPLE 2

One layered boards having the dimensions 550×350×16 mm were produced on a laboratory scale from green wood chips having an original moisture content of about 50%. The chip raw material was predried to moisture contents of about 30, 20, 10 and 2 percent, respectively. After intermediate storing for a couple of days, part of the particles were treated with 0.88 kg per 100 kg particles, dry weight, of a customary wax dispersion containing 50% wax, having a melting point of about 50° C. and part of the particles with 2–5 kg of the liquid of example 1. After the treatment all fractions, except the one already having a moisture content of 2%, were dried to a moisture content of about 2%. The drying was carried out with hot air and the temperature of the particles was 65° to 70° C. at the final stage of the drying. The particles were sieved to remove fractions less than 0.25 mm and greater than 8 mm, and were then glued with 60% urea-formaldehyde resin containing 100 parts by weight of resin of type 1143 S, 1.2 parts by weight of water, 6.5 parts by weight of ammonium chloride (20%), and 0.65 parts by weight of ammonia (25%). The amount of glue was 9 percent by weight, calculated as dry resin on dry particles. The particles were then shaped into a mat layer and pressed at 185° C. for 9, 10 and 11 seconds per mm of board thickness, respectively. Four panels were produced for each fraction and press-time.

The results are shown in Table 2, where the average for all boards of each moisture content is given, i.e. the average for 12 boards. The tests A to D are for boards treated with the wax dispersion and the tests E to H for boards treated with the liquid containing urea.

EXAMPLE 3

On a factory-scale 16 mm thick three-layered full-size particle boards were produced according to the following:

The treatment liquid of example 1 was sprayed in an amount of (per 100 kg dry weight of particles) 1.35 kg for the surface-particles and 2.5 kg for the middle-particles on dried but cold particles immediately before gluing with 12.5 percent by weight of urea-formaldehyde glue (dry glue, dry particles) for the surface-particles and 10.5 percent by weight for the middle-particles, mat formation and pressing were then carried out.

During an interruption in the process described above 2 kg of the treatment liquid were instead added per 100 kg of particles (dry weight) both to the particles for the middle layer and for the surface layer before the raw particles were dried, when they had a moisture content of abt. 50%. After drying with hot flue gases to a final moisture content of about 2.5% and a final particle temperature of about 70° C., the boards were glued, shaped and presses as previously.

The results are shown in Table 3, where test I realtes to the addition to dry particles immediately before gluing and test II relates to the addition to wet particles before their drying.

TABLE 2

| Test | Additive | Moisture content at addition | Density kg/m$^3$ | Bending strength (MOR) MPa | Internal bond (IB) MPa | Swelling 2 hours % | Dry content of sample at perforator test g/kg | Perforator value mg $CH_2O$/100 g |
|---|---|---|---|---|---|---|---|---|
| A | wax | 2 | 695 | 12.3 | 0.46 | 9.4 | 927 | 22 |
| B | wax | 8 | 708 | 15.3 | 0.81 | 8.1 | 941 | 16 |
| C | wax | 20 | 715 | 14.8 | 0.78 | 7.2 | 934 | 19 |
| D | wax | 28 | 726 | 15.4 | 0.92 | 8.3 | 930 | 17 |
| E | wax/urea | 2 | 686 | 11.2 | 0.47 | 10.3 | 934 | 6.9 |
| F | wax/urea | 8 | 700 | 14.5 | 0.81 | 8.0 | 941 | 7.5 |
| G | wax/urea | 20 | 717 | 13.7 | 0.70 | 8.2 | 938 | 7.3 |
| H | wax/urea | 28 | 709 | 12.8 | 0.75 | 10.8 | 931 | 7.8 |

TABLE 3

| Test | Density kg/m³ | Bending strength (MOR)MPa | Internal bond (IB) MPa | Swelling 2 hours % | Absorption | Perforator value mg $CH_2O$/100 g |
|---|---|---|---|---|---|---|
| I | 686 | 15.3 | 0.49 | 3.8 | 16.6 | 10.0 |
| II | 687 | 18.0 | 0.59 | 3.7 | 15.9 | 9.9 |

EXAMPLE 4

In a chip board manufacturing plant, other than that of Example 3, full size boards of 22 mm thickness were produced from chips, having an initial moisture content above 50 percent, which moisture content was reduced to about 3 percent in a drier, which also raised the temperature of the chips to about 85° C. From the dried chips three-layer mats were formed, having a glue content of 9% in the middle layer and 11% (dry glue/dry chips) in the surface layers, and pressed at 190° C.

In a first run (I) the glue was an urea-formaldehyde resin with a mole ratio of formaldehyde to urea of 1.22 and an ordinary (50%) wax dispersion was added on dry and cool chips to include an amount of 0.5% wax (dry wax/dry chips).

In a second run (II) the same glue was added but the wax dispersion was substituted for the urea/wax dispersion of Example 1, which was added in an amount of 2.8 weight percent (dry chips) on the wet chips before the drier.

In a third run (III) the conditions in the first run were repeated with the only difference that a glue with a mole ratio of formaldehyde to urea of only 1.05 was used.

The results are given in Table 4 as averages of several test samples.

TABLE 4

| Test | Density kg/m³ | Bending strength (MOR)MPa | Internal bond (IB) MPa | Swelling 2 hours % | Perf. value mg $CH_2O$/100 g | WKI-value mg $CH_2O$/m²/24 h |
|---|---|---|---|---|---|---|
| I | 703 | 18.9 | 0.91 | 2.9 | 23 | 170 |
| II | 723 | 20.8 | 1.11 | 1.8 | 8.6 | 71 |
| III | 697 | 16.9 | 0.67 | 2.2 | 8.7 | 79 |

We claim:

1. A method for the production of particle boards by addition of a hydrophobic agent and a curable glue to wood based particles, formation of the particles into a mat and subsequent curing of the glue by application of heat and pressure, comprising the steps of
   (a) adding a hydrophobic agent, which is solid or non-fluid at normal temperatures, to the wood based particles,
   (b) maintaining both the hydrophobic agent and the wood based particles at temperatures above the melting temperature of the hydrophobic agent,
   (c) maintaining contact under agitation between the heated hydrophobic agent and the heater wood based particles, so as to spread and distribute the hydrophobic agent over the surfaces of the particles, and
   (d) subsequently adding a formaldehyde-based glue to the particles from step (c) before mat formation and pressing.

2. A method for the production of particle boards by addition of a hydrophobic agent and a curable glue to wood based particles, formation of the particles into a mat and a subsequent curing of the glue by application of heat and pressure, comprising the steps of,
   (a) adding a hydrophobic agent, which is solid or non-fluid at normal temperatures in the form of an aqueous dispersion to the wood based particles in an amount sufficient to leave on the particles between 0.1 to 5 percent of the particle dry weight of hydrophobic agent,
   (b) maintaining both the hydrophobic agent and the wood based particles at temperatures above the melting temperature of the hydrophobic agent,
   (c) maintaining contact under agitation between the heated hydrophobic agent and the heated wood based particles, so as to spread and distribute the hydrophobic agent over the surfaces of the particles, and
   (d) subsequently adding a formaldehyde-based glue to the particles from step (c) before mat formation and pressing.

3. A method according to claim 1, characterized in that the hydrophobic agent, in the form of an aqueous dispersion, is added to the particles, when these have a temperature below the melting point of the hydrophobic agent and that the temperature above said melting point is then raised.

4. A method according to claim 1, characterized in that water is removed by drying of the particles after the addition of the hydrophobic agent.

5. A method according to claim 4, characterized in that the drying is carried out when the particle mixture is heated.

6. A method according to claim 4, characterized in that at least 5 percent by weight of water, based on the dry weight of the particles, is removed by drying.

7. A method according to claim 1, characterized in that a formaldehyde absorbing agent is added to the particles before the heating of the hydrophobic agent.

8. A method according to claim 7, characterized in that the formaldehyde absorbing agent is added in the form of a solution.

9. A method according to claim 1, characterized in that the particles are subjected to a drying before the hydrophobic agent is added.

10. A method according to claim 7, characterized in that only some of the layers were treated with formaldehyde absorbing agent at the production of multi-layered boards.

* * * * *